US011833521B2

(12) United States Patent
Anderson

(10) Patent No.: US 11,833,521 B2
(45) Date of Patent: Dec. 5, 2023

(54) APPARATUS AND METHOD FOR A CHIPPER ASSEMBLY

(71) Applicant: Astec Industries, Inc., Chattanooga, TN (US)

(72) Inventor: Nathan Anderson, Harrisburg, OR (US)

(73) Assignee: Astec Industries, Inc., Chattanooga, TN (US)

( * ) Notice: Subject to any disclaimer, the term of this patent is extended or adjusted under 35 U.S.C. 154(b) by 281 days.

(21) Appl. No.: 17/110,884

(22) Filed: Dec. 3, 2020

(65) Prior Publication Data

US 2021/0162424 A1 Jun. 3, 2021

Related U.S. Application Data

(60) Provisional application No. 62/942,951, filed on Dec. 3, 2019.

(51) Int. Cl.

| | |
|---|---|
| ***B02C 18/14*** | (2006.01) |
| ***B02C 18/22*** | (2006.01) |
| ***B27L 1/00*** | (2006.01) |
| ***B27L 11/00*** | (2006.01) |
| ***B27L 11/02*** | (2006.01) |

(52) U.S. Cl.

CPC ..... *B02C 18/14* (2013.01); *B02C 18/2225* (2013.01); *B27L 1/00* (2013.01); *B27L 11/00* (2013.01); *B27L 11/002* (2013.01); *B27L 11/005* (2013.01); *B27L 11/02* (2013.01)

(58) Field of Classification Search

CPC ..... B27L 11/00; B27L 11/002; B27L 11/005; B27L 11/02; B27L 11/04; B27L 11/06; B27L 11/08; B27L 1/12; B27L 1/122; B27L 1/127

See application file for complete search history.

(56) References Cited

U.S. PATENT DOCUMENTS

| | | | | |
|---|---|---|---|---|
| 4,640,325 A | | 2/1987 | Vaders | |
| 5,020,579 A | | 6/1991 | Strong | |
| 6,016,855 A | * | 1/2000 | Morey | B02C 23/04 241/101.76 |

(Continued)

OTHER PUBLICATIONS

International Search Report and Written Opinion of counterpart PCT Application No. PCT/US2020/063061 dated Apr. 28, 2021.

*Primary Examiner* — Matthew Katcoff

(74) *Attorney, Agent, or Firm* — Chambliss, Bahner & Stophel, P.C.; Stephen D. Adams

(57) ABSTRACT

A chipping machine includes a debarking assembly, a chipper assembly, and a log advance system to conveys logs through the chipping machine and into contact with the debarking assembly and chipper assembly. A rotating chipper disk cuts chips from the log. A housing encloses the chipper disc and includes a spout that provides an exit path for chips out of the housing. The chipper assembly includes a first path for collecting bark and directing bark out of the machine. A second path that is separate from the first path collects trash and directs the collected trash to first path and out of the machine. An inlet of the second path is an opening formed in a base of the housing. The second path includes a chute onto which trash falls and then slides under the force of gravity to the first path.

2 Claims, 11 Drawing Sheets

(56) References Cited

U.S. PATENT DOCUMENTS

| | | | | |
|---|---|---|---|---|
| 7,896,268 | B2 * | 3/2011 | Robinson | B27L 11/06 144/176 |
| 10,376,896 | B2 * | 8/2019 | Pallmann | B27L 11/005 |
| 10,773,260 | B2 * | 9/2020 | Walcutt | B02C 18/16 |
| 2010/0127107 | A1 | 5/2010 | Grant et al. | |
| 2015/0076265 | A1 | 3/2015 | Peterson et al. | |
| 2017/0305032 | A1 * | 10/2017 | Ragnarsson | B27L 1/122 |
| 2018/0250844 | A1 | 9/2018 | Harness | |

* cited by examiner

APPARATUS AND METHOD FOR A CHIPPER ASSEMBLY

CROSS-REFERENCES TO RELATED APPLICATIONS/PATENTS

This application relates back to and claims the benefit of priority from U.S. Provisional Application for Patent Ser. No. 62/942,951 titled "Chipper Housing Having Increased Spout Angle" and filed on Dec. 3, 2019.

FIELD OF THE INVENTION

The present invention relates generally to apparatuses and methods for chipping machines, and particularly to apparatuses and methods for chipping machines having chipper hood assemblies.

BACKGROUND AND DESCRIPTION OF THE PRIOR ART

Various methods and apparatuses are used to control the segregation and discharge of chips and trash from a chipping machine. Conventional apparatuses and methods, however, suffer from one or more disadvantages.

For example, with initial reference to FIG. 1, machine 10 is a combination debarker and disc-type log chipping machine that is adapted to process logs, such as log 12. Machine 10 includes frame 13 on which the operating components of the machine are mounted. Frame 13 has a long axis F. Log 12 is carried through the machine 10 in processing direction D, which is substantially parallel to frame axis F, by a log advance system comprising a plurality of rotating feed rollers. Upper debarker feed assembly 14 is pivotally mounted on the frame 13 of the machine 10 above the log 12 and is adapted to rotate feed roller 15 in a clockwise direction (as shown in FIG. 1). Similarly, upper chipping feed assembly 16 is pivotally mounted on the frame 13 of the machine 10 above the log 12 and is adapted to rotate feed roller 17 in a clockwise direction (as shown in FIG. 1). Lower feed assemblies are mounted below the log 12 and include rollers 18 and 20 that are adapted to rotate in a counterclockwise direction (as shown in FIG. 1). Upper feed roller 15 and lower feed roller 18 cooperate to move log 12 into contact with debarking assemblies 21, 22 and 23. Each of the debarking assemblies includes a rotating shaft 24 to which are attached a plurality of flail chains 25. Each rotating shaft 24 rotates about an axis of rotation that is perpendicular to the plane of the page of FIG. 1. Each flail chain 25 has a fixed end 26 that is attached to a shaft 24 and a free end 27. Each flail chain 25 has a length that defines an arc of rotation AR of the free end 27 of the flail chain. Rotation of the shafts 24 causes the chains 25 to flail the bark from the log 12. As shown in FIG. 1, the shaft 24 of first upper debarking assembly 21 rotates in a clockwise direction, while the shafts of lower debarking assembly 22 and second upper debarking assembly 23 rotate in a counterclockwise direction. Upper debarking assemblies 21 and 23 include housings 28 and 29 respectively that are pivotally mounted to the frame 13 of machine 10. Much of the bark that is removed by the flail assemblies 21, 22 and 23 and other refuse or trash 31 (e.g., tramp metal) falls into bark removal discharge 30 for removal from the machine. A flailed log advance system comprising upper feed roller 17 and lower feed rollers 20 cooperate to advance the flailed log into a chipping mechanism comprising chipper disc 32, which rotates in a clockwise direction (as shown in FIG. 1) to reduce the log to chips that pass out of the machine through spout 34, which routes chips formed by chipper disc 32 away from machine 10.

With reference now to FIGS. 2 and 3, a conventional chipper disc 32 used in a chipping operation are shown. Chipper disc 32 is provided with four pockets 45 that are each provided a knife assembly 46. Chipper disc 32 rotates about axis 47 in rotation direction R and logs are advanced towards an upstream side or front face 48 of the chipper disc formed by separate face plates 49 and into contact with the rotating knife assemblies, which creates chips from the logs. As chips are created, they pass the through chipper disc 32 via the pockets 45 (shown in FIG. 3). Paddles 52 are bolted to a discharge or downstream side or rear face of 53 of the chipper disc 32 and rotate with the chipper disc. Paddles 52 function like fan blades to create an airflow and to direct chips out of the chipper via the spout 34 (shown in FIG. 1). Before the chips are guided out of the spout 34 by paddles 52, they are forcefully thrown into a back wall 50 of chipper disc housing 35 at a high velocity. Eventually, as chipping operations continue, a section 51 of the back wall 50 wears and requires replacement. This replacement is typically labor intensive, requiring at least a portion of the back wall 50, which is often formed from steel, to be cut away and for a new steel section to be welded in its place.

Referring now to FIGS. 4 and 5, a chipper disc 32 is shown in a conventional "clamshell" housing 35, which covers chipper disc during chipping operations, and is formed by a base 36 and a hood 37, formed by stationary portion 37A and rotatable portion 37B, that is typically welded to the base. A wear liner 43 (shown in FIG. 5) is conventionally welded inside of the housing 35 to protect the hood 37 as chips are created. Similarly, a belly band 55 (shown in FIG. 1) is a curved metallic liner that is welded into the base 36 of the housing 35 under the chipper disc 32 that helps to reinforce the housing and to direct chips out of the machine 10 via the spout 34. Wear liner 43 and belly band 55 must be periodically removed from the housing 35 and replaced. In each case, replacement of these components is labor intensive. This is due, in part, to the construction of the housing 35. Conventionally, portion 37B is pivotally mounted to stationary portion 37A by a hinged connection 38, which enables the hood to be rotated upwards away from the base and held in place by hydraulic cylinder 44 in order to replace and maintain chipper disc 32, including knives on the disc, and wear liner 43. When rotated upwards, hood 37 separates from base 36 along parting line 39 (on plane 40), which is located at a centerline of the chipper disc between the top end 41 and bottom end 42 of chipper disc 32. Replacing the wear liner 43 requires the hood 37 to be removed entirely from the housing 35. The wear liner 43 is then cut out of hood 37 and is replaced by welding a new wear liner into the hood. Alternatively, the entire hood 37 may require replacement when the wear liner 43 is worn and needs replacement. Replacing the belly band 55 sometimes requires the entire hood 37 as well as the chipper disc to be removed.

As shown above, conventional chipper hoods are undesirably complex and expensive to manufacture, repair, and maintain. The clamshell method for opening conventional chipper hoods also results in insufficiently safe access to chipper knives for removal, replacement, and maintenance and requires a weld-in wear component that is undesirably heavy and difficult to remove and replace.

Next, as shown in FIGS. 1 and 4, the spout 34 is conventionally joined to the base 36 of the housing 35 and directs chips created by chipper disc 32 away from machine 10. The height of the base 36 impacts the size of the inlet of the spout (i.e., the inlet is joined to the base 36 of the housing 35 to enable chips to pass from the housing into the spout) and also the exit angle of the spout. Conventional chipper hoods produce an undesirably low chip exit angle and undesirably low volume. When the spout 34 has a small opening or the exit angle is shallow, chips tend to follow the motion of the chipper disc 32, bypassing the spout and traveling from the base 36 upwards into the hood 37 and then back to the base. This causes chips to remain in the housing longer than necessary, which makes the chipping operation slower, hotter, and generally less efficient. This also causes increased wear on the hood 37 and further reduces the size of the chips to create unwanted pins and fines. Therefore, a larger opening and a steeper exit angle would enable chips to be more efficiently directed away from the machine 10.

Additionally, in many conventional chipping machine, a second discharge opening, sometimes called an overs chute 54, is often located immediately adjacent the spout 34. The overs chute 54 enables trash, including limbs, tramp metal, and other materials that are not easily formed into chips, to be discharged via the side of machine 10. However, unchippable material ejected from the machine 10 via overs chute 54 can travel long distances at high velocities and, therefore, can be a hazard. Additionally, ejecting unchippable material via overs chute 54 and bark and other trash via bark removal discharge 30 (FIG. 1) creates at least two piles of refuse that must be collected.

ADVANTAGES OF THE PREFERRED EMBODIMENTS OF THE INVENTION

Accordingly, it is an advantage of the preferred embodiments of the invention claimed herein to provide an apparatus and method for a chipper hood that utilizes a pivoting access door that does not require an actuator such as a hydraulic cylinder to be moved between an open and a closed position and provides safe and easy access to chipper knives for removal, replacement, and maintenance. It is also an advantage of the preferred embodiments of the invention claimed herein to provide an apparatus and method for a chipper hood that is not complex and expensive to manufacture, repair, and maintain. It is another advantage of the preferred embodiments of the invention claimed herein to provide an apparatus and method for a chipper hood that does not require a weld-in wear component that is undesirably heavy and difficult to remove and replace. It is still another advantage of the preferred embodiments of the invention claimed herein to provide an apparatus and method for a chipper hood that has a parting line, i.e., the junction of the chipper hood and the chipping machine housing, that is above the centerline of the rotating chipper disk, resulting in a higher chip exit angle and volume and reduced heat, pins, fines, and wear in the hood and the chipping machine components contained therein. It is yet another advantage of the preferred embodiments of the invention claimed herein to provide an apparatus and method for a chipper hood that requires less frequent repair and replacement and has improved durability, efficiency, and speed and a longer lifespan.

It is an advantage of the preferred embodiments of the invention claimed herein to provide an apparatus and method for a trash discharge chute assembly that discharges trash from a chipping machine in the same area as other debris, such as bark, is discharged. It is also an advantage of the preferred embodiments of the invention claimed herein to provide an apparatus and method for a trash discharge chute assembly that does not discharge trash from the side of a chipping machine in a direction substantially perpendicular to the direction of travel of a log through the chipping machine. It is another advantage of the preferred embodiments of the invention claimed herein to provide an apparatus and method for a trash discharge chute assembly that does not discharge trash from a chipping machine at a distance spaced far apart from the chipping machine or at a high velocity. It is still another advantage of the preferred embodiments of the invention claimed herein to provide an apparatus and method for a trash discharge chute assembly that does not expose individuals in the area of the chipping machine to hazards or is unnecessarily labor-intensive.

Additional advantages of the preferred embodiments of the invention will become apparent from an examination of the drawings and the ensuing description.

EXPLANATION OF THE TECHNICAL TERMS

The use of the terms "a," "an," "the," and similar terms in the context of describing the invention are to be construed to cover both the singular and the plural, unless otherwise indicated herein or clearly contradicted by context. The terms "comprising" "having," "including," and "containing" are to be construed as open-ended terms (i.e., meaning "including, but not limited to,") unless otherwise noted. The terms "substantially," "generally," and other words of degree are relative modifiers intended to indicate permissible variation from the characteristic so modified. The use of such terms in describing a physical or functional characteristic of the invention is not intended to limit such characteristic to the absolute value which the term modifies, but rather to provide an approximation of the value of such physical or functional characteristic. All methods described herein can be performed in any suitable order unless otherwise specified herein or clearly indicated by context.

Terms concerning attachments, coupling and the like, such as "attached," "connected," and "interconnected," refer to a relationship wherein structures are secured or attached to one another either directly or indirectly through intervening structures, as well as both moveable and rigid attachments or relationships, unless specified herein or clearly indicated by context. The term "operatively connected" is such an attachment, coupling or connection that allows the pertinent structures to operate as intended by virtue of that relationship.

The use of any and all examples or exemplary language (e.g., "such as," "preferred," and "preferably") herein is intended merely to better illuminate the invention and the preferred embodiments thereof, and not to place a limitation on the scope of the invention. Nothing in the specification should be construed as indicating any element as essential to the practice of the invention unless so stated with specificity. Several terms are specifically defined herein.

As used herein, the term "trash" means any material that is not practicably capable of being chipped by a chipping machine. The term "trash" includes without limitation tramp iron and other similar metal materials, limbs, branches, and the like.

SUMMARY OF THE INVENTION

The above and other needs are met by a chipping machine that is adapted to be placed on an operating surface. The chipping machine includes frame having a long axis. A debarking assembly for removing bark from log and a chipper assembly for reducing a log to chips are mounted to the frame. The chipper assembly includes a chipper disk adapted to rotate about a chipper disk axis in a plane of rotation that is angled with respect to the long axis of the frame of the chipping machine in order to cut chips from the log that is presented to the chipper disk in a processing direction. The chipper disk axis defines a processing plane. The log approaches an upstream side of the chipper disk and chips depart from a downstream side of the chipper disk. The chipper assembly includes a first path having a first inlet configured to collect bark removed from the log and an outlet that directs collected bark out of the machine. A housing encloses at least a portion of the chipper disc. The housing includes a spout located on a downstream side of the chipper disk that is adapted to provide an exit path for chips cut by the chipper disk from said log out of housing. Additionally, a second path having a second inlet that is separate from the first inlet of the first path and that is located in the housing on the upstream side of the chipper disk is configured to collect trash. An outlet of the second path directs the collected trash to the outlet of the first path and out of the machine with the collected bark. In certain embodiments, the second inlet is an opening formed in the base of the housing and the second path comprises a chute onto which trash falls and then slides under the force of gravity to the first path. A log advance system conveys the log through the chipping machine in the processing direction and into contact with the debarking assembly and chipper assembly.

In certain embodiments, the chipper disk includes a plurality of knife assemblies and the plane of rotation is disposed at an acute angle to the long axis. Additionally, the processing direction is parallel to the long axis. Finally, the processing plane is substantially parallel to the operating surface on which the chipping machine is placed. In certain embodiments, the housing includes a base that is mounted to the frame of the chipping machine, a hood that is removably mounted to the base along a parting line that is raised above the processing plane, and a spout that is attached to and extends upwardly from the base. The parting line may define a hood mounting plane that is substantially parallel to and is spaced vertically above the processing plane with respect to the operating surface. In certain embodiments, the chipper disk has a chipper disk diameter and the hood mounting plane is placed at least about 2.5% of the chipper disk diameter above the processing plane. In certain embodiments, the frame of the chipping machine has a top surface to which the base of the housing is mounted and the spout is partially defined by a straight portion of a belly band located within the housing, where the straight portion of the belly band is disposed at an exit angle that is measured from the top surface of the frame to be within the range of 20° and 45°.

The present disclosure also provides a housing assembly that adapted for use on a chipping machine having a base for surrounding a lower portion of a rotating chipper disk with a chipper disk upper portion, a chipper disk lower portion, at least one chipper knife assembly, and a centerline. The housing assembly includes a hood having a stationary portion configured for removable attachment to the base to form a housing for substantially enclosing the chipper disk. Additionally, an access opening is formed in the stationary portion for providing access to an inside of the housing. An access door covers the access opening and is adapted to be moved between an open position where the access door is uncovered and a closed position where the access door is covered. A parting line is located at a junction of the base with the hood. The hood and the access door are adapted to substantially surround the chipper disk upper portion while the base substantially surrounds the chipper disk lower portion. In certain embodiments, the housing assembly includes the base and a chute having an inlet formed in the base of the housing assembly on an upstream side of the chipper disk and an outlet. The inlet is preferably sized and configured to collect trash within the housing assembly and the chute is configured to automatically carry the trash out of the housing assembly under the force of gravity. In certain embodiments, the stationary portion comprises a first side, a second side opposite and spaced apart from said first side, and a third side connecting the first side and the second side, and wherein the stationary portion is sized such that the parting line is disposed vertically higher than the centerline of the rotating chipper disk.

The present disclosure also provides a wear component adapted for use on a chipping machine that includes a rotating chipper disk and that is adapted to be placed on an operating surface and operated to reduce a log to chips, where the chipping machine has a housing for enclosing the rotating chipper disk that is formed by a hood that is removably connected to a base along a parting line. The wear component includes a mounting component for removably mounting the wear component to a mounting surface inside of the housing. Additionally, the wear component includes a sacrificial chip contact surface that is sized and configured to be contacted by chips traveling within the housing at a high speed, to reduce the speed of the chips that contact the contact surface, and to be worn away by such contact with said chips.

In certain embodiments, the wear component is located entirely below the parting line throughout the operation of the chipping machine. In certain embodiments, the wear component extends across the parting line during the operation of the chipping machine. In certain embodiments, the wear component moves with the chipper disk during the operation of the chipping machine. In certain embodiments, the wear component remains stationary during the operation of the chipping machine. In certain embodiments, the wear component includes a belly band that is located in the base and that has a curved portion having an end joined to an end of a straight portion. During the operation of the chipping machine, the curved portion of the belly band at least partially surrounds a lower portion of the chipper disk and the straight portion of the belly band is disposed in a spout through which chips exit the housing. In certain embodiments, paddles are located on a downstream side of the chipper disk and the wear component is mounted to the paddles to provide a space between the downstream side of the chipper disk and the wear component through which chips travel prior to contacting the sacrificial chip contact surface. In certain embodiments, a first wear component is located entirely below the parting line and remains stationary throughout the operation of the chipping machine. At the same time, a second wear component that extends across the parting line and that moves with the chipper disk during the operation of the chipping machine.

BRIEF DESCRIPTION OF THE DRAWINGS

The presently preferred embodiments of the invention are illustrated in the accompanying drawings, in which like reference numerals represent like parts throughout, and in which.

DESCRIPTION OF THE PREFERRED EMBODIMENTS OF THE INVENTION

This description of the preferred embodiments of the invention is intended to be read in connection with the accompanying drawings, which are to be considered part of the entire written description of this invention. The drawings are not necessarily to scale, and certain features of the invention may be shown exaggerated in scale or in somewhat schematic form in the interest of clarity and conciseness.

Cover with Access Door

Figure 6:
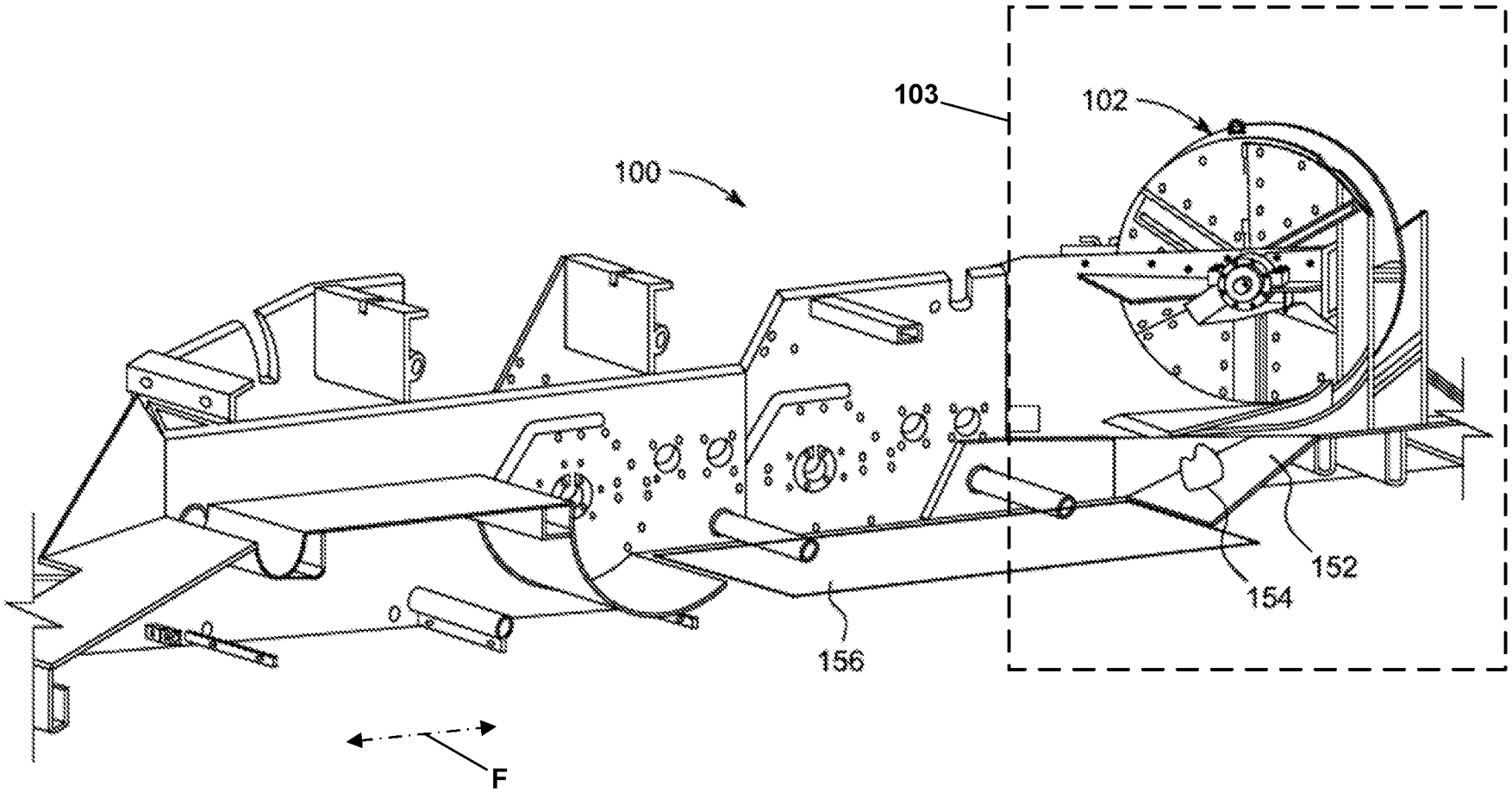
FIG. 6 is a side elevation view, partially in section, of a combination debarking and disc-type chipping machine according to an embodiment of the present invention, where certain components are removed for viewing clarity.
Figure 7:
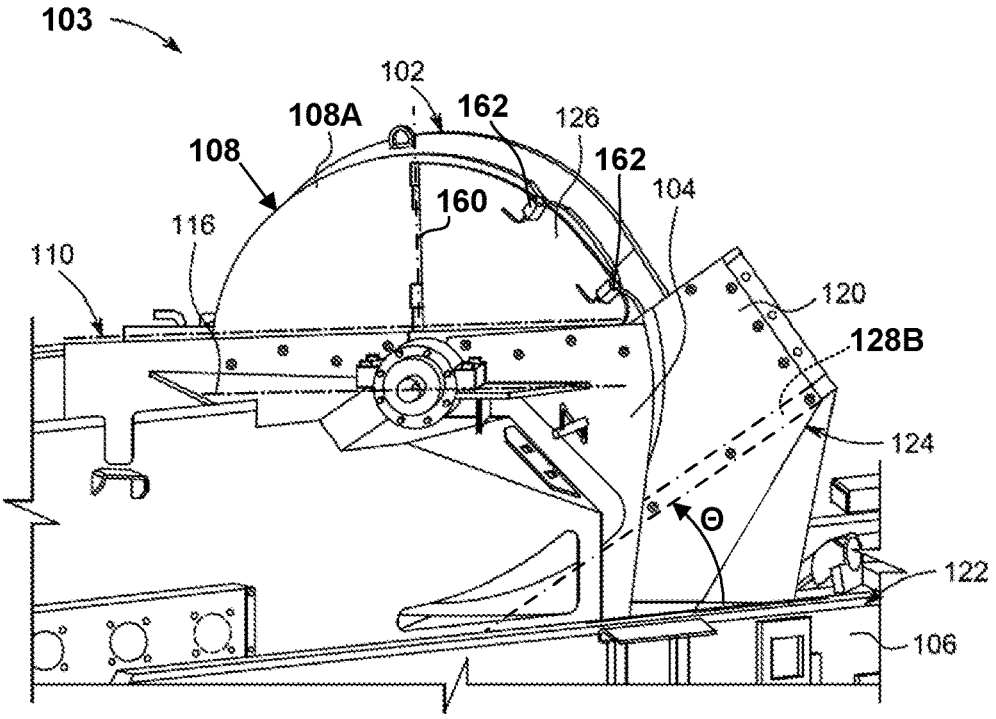
FIG. 7 is a front perspective view illustrating the chipping machine of FIG. 6.
Figure 8:
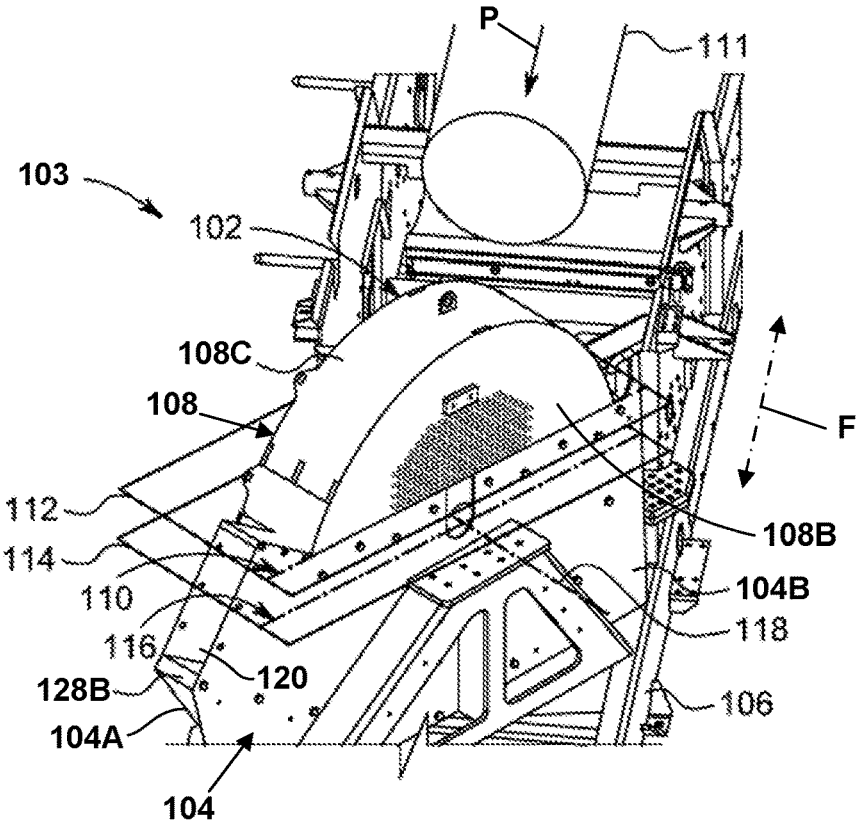
FIG. 8 is a rear perspective view illustrating the chipping machine of FIG. 6 in use to process a log.
Figure 9:
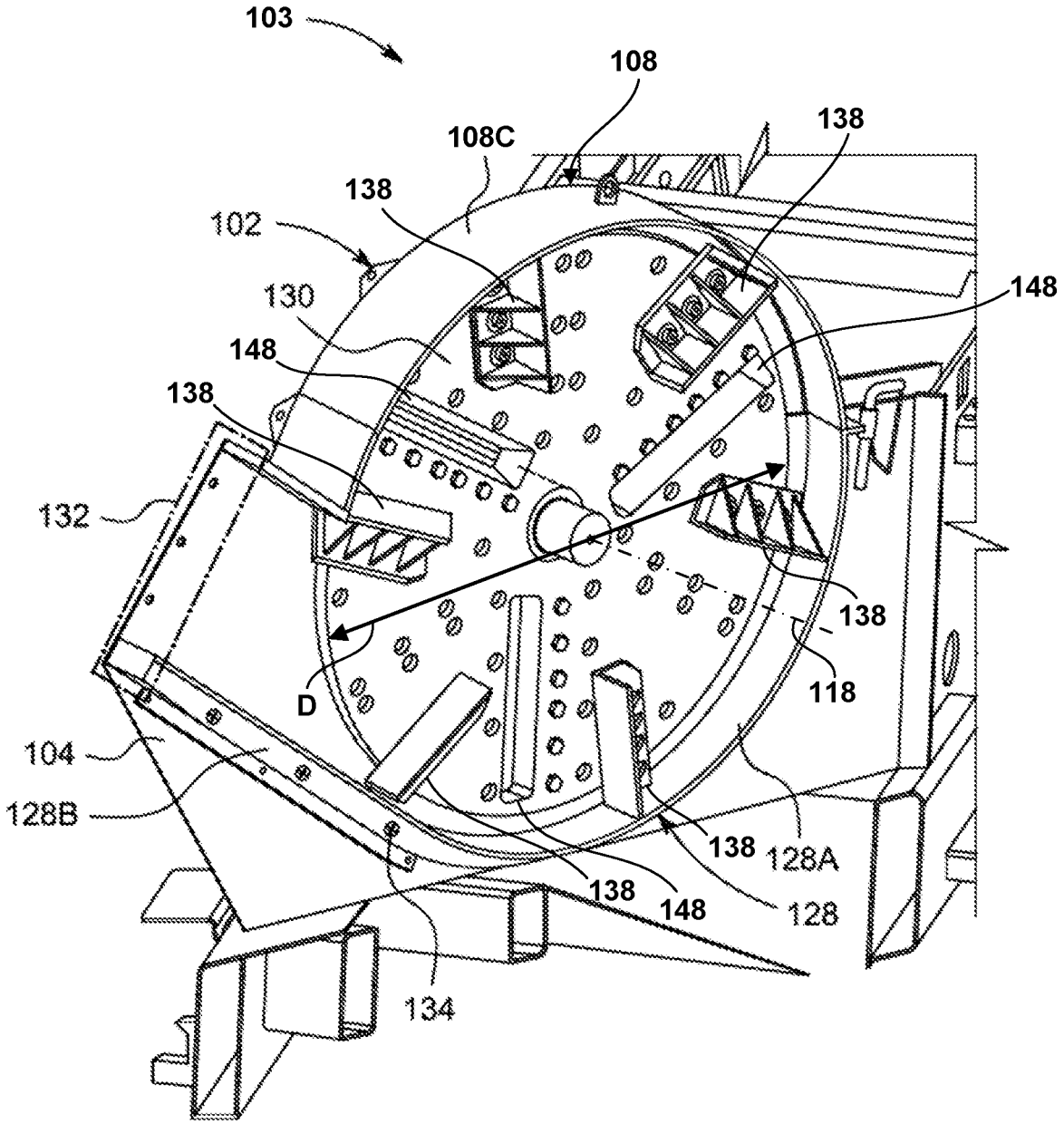
FIG. 9 is a rear perspective view of a portion of the chipping machine shown in FIG. 8 with a portion of a housing removed to illustrate an internal chipper disc and a spout.
Figure 10A:
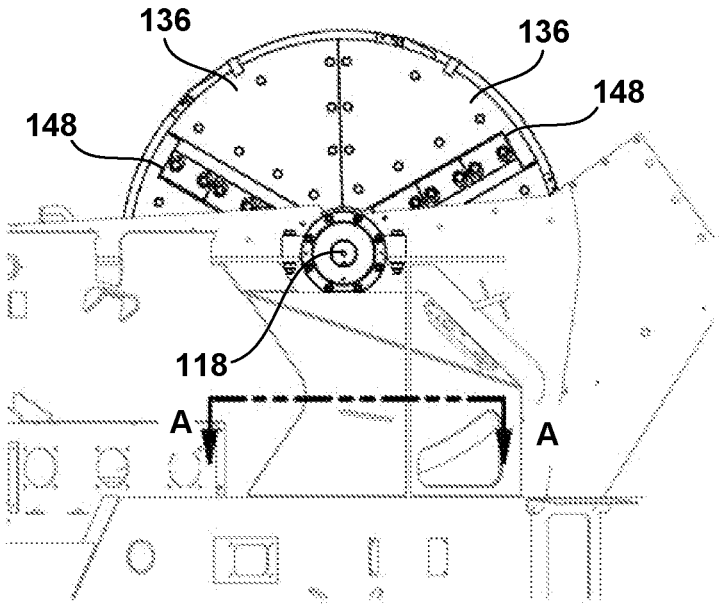
FIG. 10A is a side elevation view showing a base of the chipping machine of FIG. 6 and a chipping disc mounted to the base.
Figure 10B:
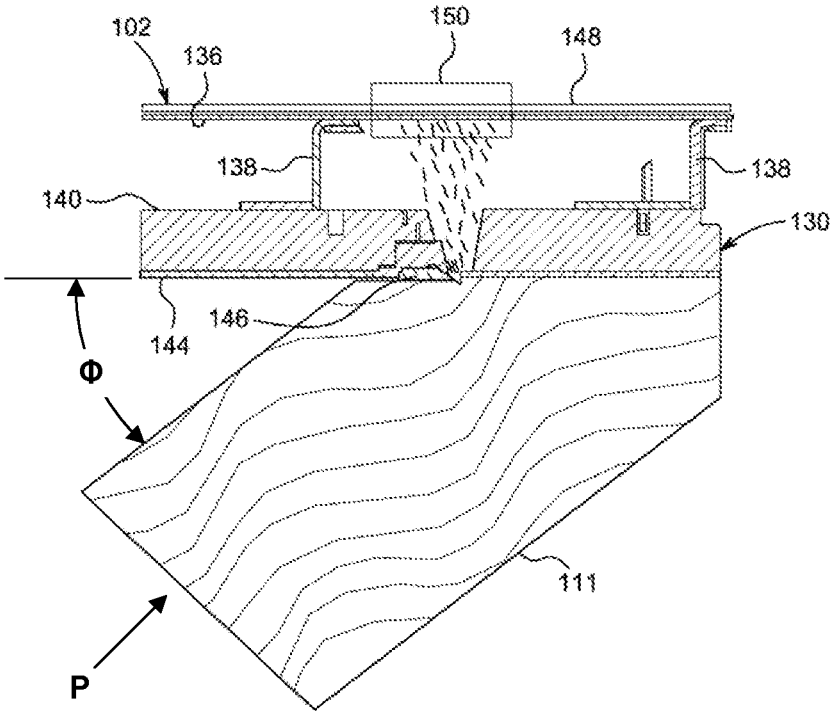
FIG. 10B is a sectional view of the base and chipping disc shown along line "A-A" and also depicting a log being processed by the chipping disc.

With reference now to FIG. 6, a portion of a disc-type chipping machine 100 for chipping logs according to an embodiment of the present invention and where certain components are removed for viewing clarity is illustrated. With further reference to FIGS. 7-9, chipping machine 100 includes a chipper assembly 103 for chipping logs 111 that includes a housing 102 for covering rotating chipper disk 130. Chipper disk 130 is substantially similar to chipper disk 32 and, thus, comprises at least one or more knife assemblies 148 and has a diameter that is essentially identical to diameter D of chipper disk 32. With further reference to FIGS. 10A and 10B, chipper disk 130 rotates about chipper disk axis 118 (shown in FIGS. 8 and 9) in a plane of rotation that is defined by its front face 144, as log 111 is advanced towards the front face of the chipper disk at an acute angle Φ to the long axis F (shown in FIG. 8) of the frame 106 of chipping machine 100 in order to cut chips from log 111 that is presented to the chipper disk in a processing direction P that is parallel to the long axis F of the frame (as shown in FIG. 8).

Housing 102 includes a base 104 that is preferably mounted to the frame 106 of the chipping machine 100 and a hood 108 that is removably mounted to the base. Preferably, hood 108 comprises first side 108A (FIG. 7), second side 108B (FIG. 8) opposite and spaced apart from the first side, and third side 108C (FIG. 8) disposed between the first side and the second side. The first side 108A of the hood 108 is preferably substantially parallel to second side 108B of the hood, and third side 108C of the hood is arcuate and is connected between the first and second sides. Hood 108 is preferably removably attached to the base 104, such as by a bolt connection. Thus, in combination, sides 108A-108C form hood 108 and are adapted to substantially surround an upper portion of the chipper disk 132. The base 104, which is detailed more below, surrounds a bottom portion of the chipper disk 132.

With reference to FIGS. 7 and 8, in preferred embodiments, housing 102 further includes one or more access doors 126, which are preferably pivotally connected to the hood 108, such as by hinges, and are positioned along one of the sides 108A, 108B of the hood. In the illustrated embodiment, only a single access door 126 is utilized. Access doors 126 are preferably adapted to move about a vertical axis 160 between an open position, where an opening (not shown) in one of the sides 108A, 108B of the hood 108 is uncovered for providing access to the inside of the housing 102, and a closed position, where the opening in the side of the hood is covered by the access door. Preferably, each access door 126 is provided with a locking mechanism 162 for securing the door in the closed position. The access doors 126 are sized and configured to allow a user located outside of the housing 108 along one of the sides 108A, 108B to remove knife assemblies 148 from the chipper disc 130 and to then extract the removed knife assembly from the housing via the open access door and then replaced with a new knife assembly. This exchange process occurs frequently (e.g., daily) and enabling the process to occur without removing the hood 108 from the base 104 will significantly speed up the process. Additionally, the knife assembly exchange process is much safer since the housing is not opened.

Use of the machine 100 may result in chips contacting the hood 108 at high velocities, which can wear away the surface of the hood. As such, in preferred embodiments, the hood 108, itself, is formed as a single, easily replaceable wear (i.e., sacrificial) component (with a separate access door 126 attached to the hood) that is mounted to base 104, such as by a bolt connection, and that may be removed as a unit by unbolting and lifting it away from the base.

Base with Increased Spout Angle

Figure 11:
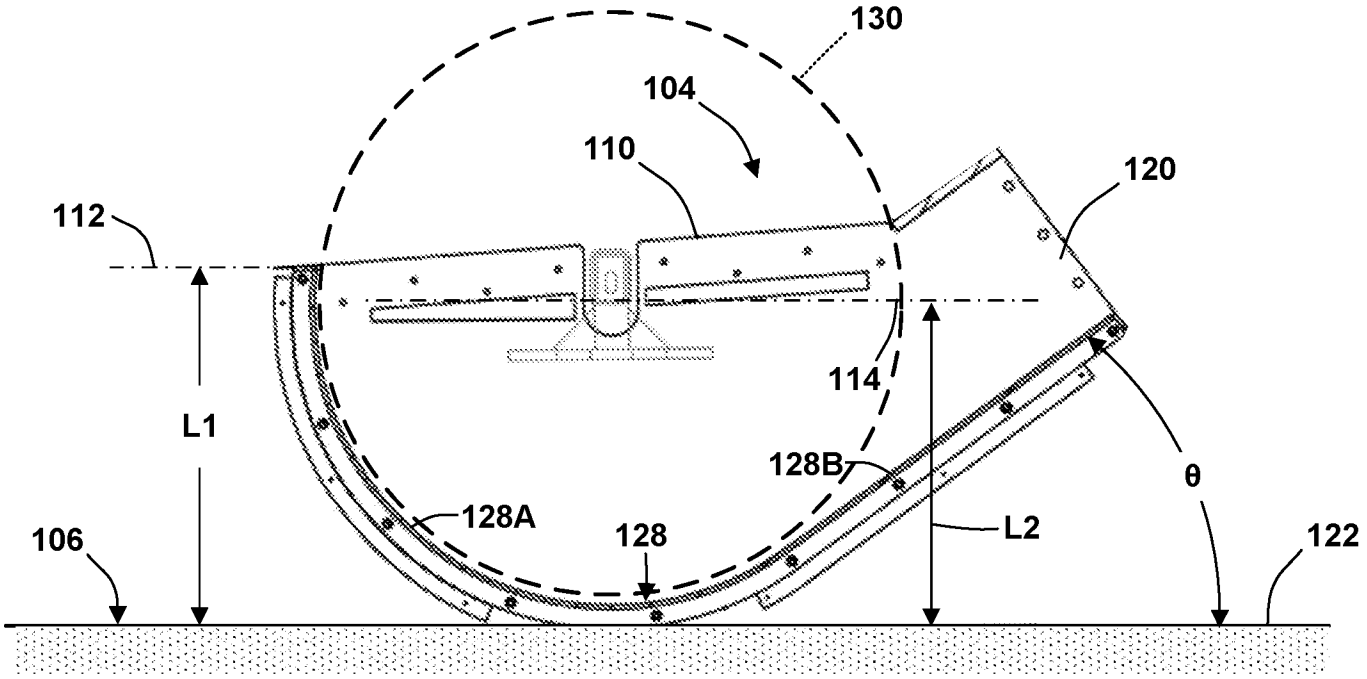
FIG. 11 is a side elevation view depicting a base of a housing mounted to a top surface of a frame according to an embodiment of the present invention.

Referring again to FIG. 8 and with further reference to FIG. 11, base 104 abuts and is preferably removably connected to the hood 108 along parting line 110. In certain embodiments, parting line 110 defines a hood mounting plane 112 that is substantially parallel to and spaced vertically above processing plane 114 that is defined by chipper disk axis 118 and is substantially parallel to the operating surface on which chipping machine 100 is placed. Processing plane 114 passes through a centerline 116 of the chipper disc, which centerline is located between a bottom and a top of the chipping disc, and is coincident with chipper disk axis 118. However, as shown in FIG. 11, the parting line 110 does not always extend parallel with the hood mounting plane 112 along its entire length. Instead, in certain preferred embodiments, the hood mounting plane 112 is positioned at least a distance L1 from a top surface 122 of the frame 106 along its entire length, where L1 represents the minimum distance separating the top surface of the frame from the parting line 110. Additionally, L1 is preferably equal to or, more preferably, greater than distance L2, which is the maximum distance separating the top surface 122 of the frame 106 from the processing plane 114. As such, parting line 110 is at least as far away from the top surface of the frame 106 as the processing plane 114 along its entire length. However, more preferably, parting line 110 is further away from the top surface 122 of the frame 106 than the processing plane 114 along its entire length.

Figure 4:
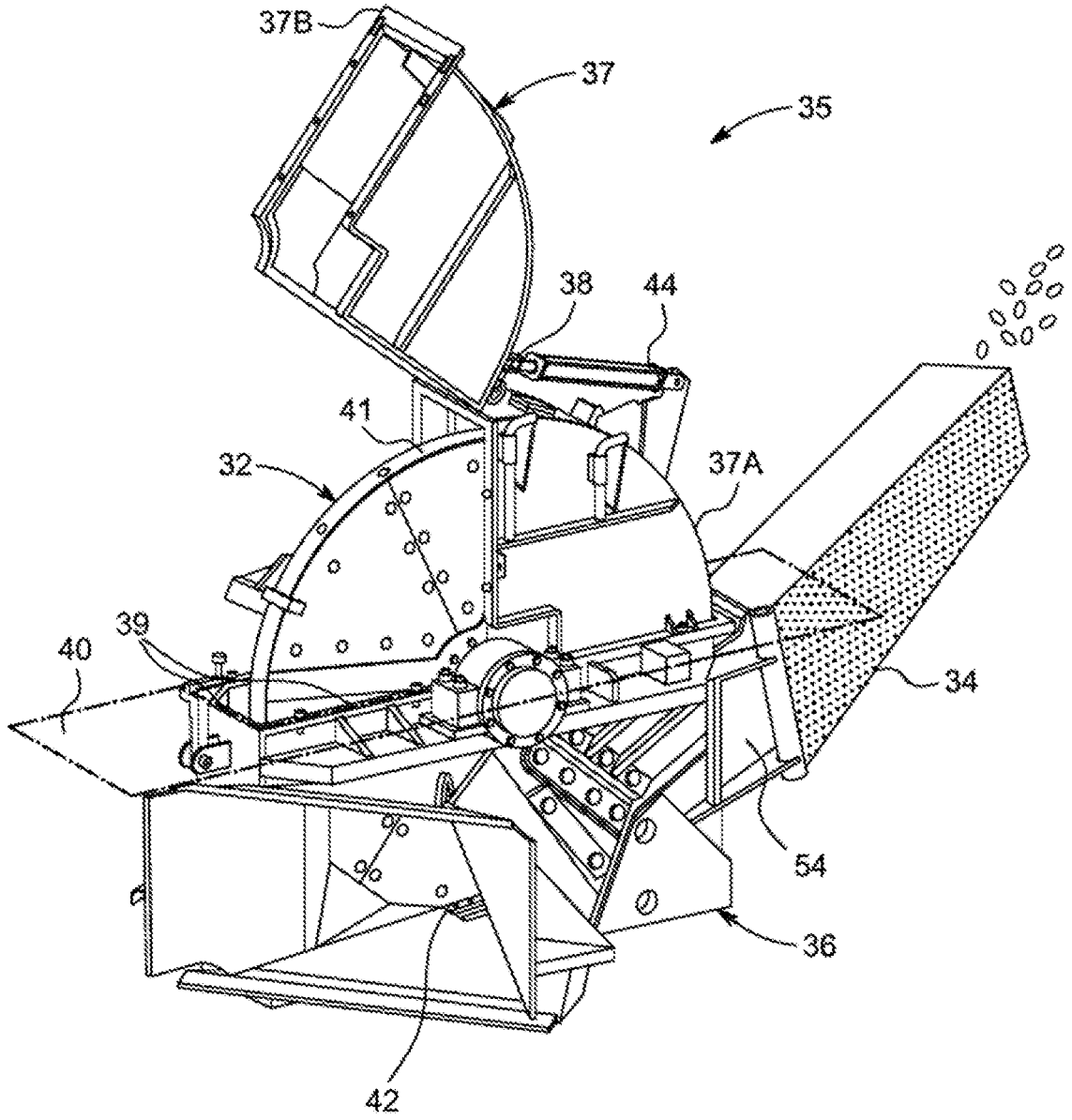
FIGURE 4 (Prior Art)
FIG. 4 is a perspective view of a portion of a chipping machine that includes a chipper disc and a conventional "clamshell" housing.
Figure 5:
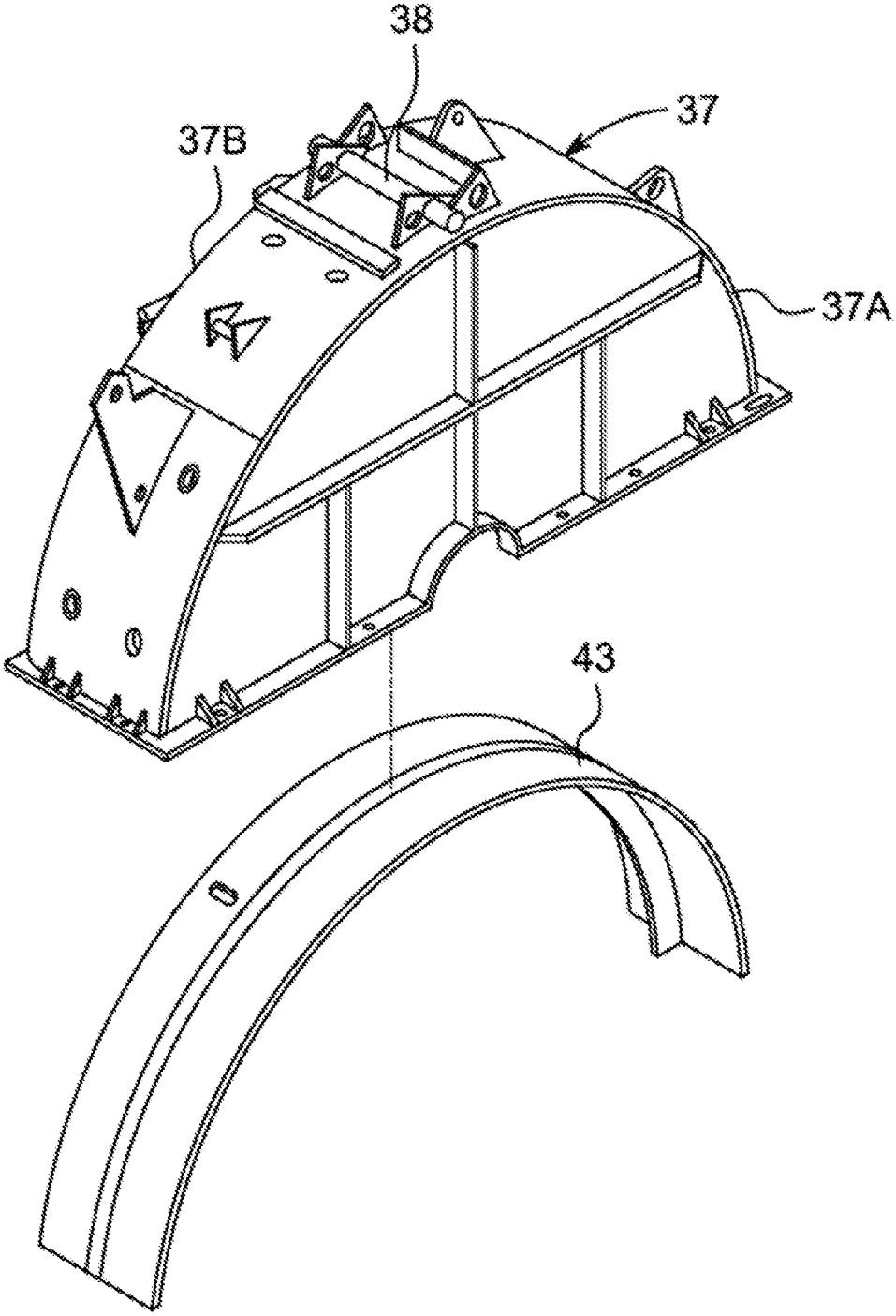
FIGURE 5 (Prior Art)
FIG. 5 is a perspective view of a hood for a conventional chipper housing.

A spout 120 is joined to and extends upwardly away from base 104 at a high chip exit angle Θ. In this particular embodiment, exit angle Θ is measured from the top surface 122 of the frame 106 to which the base 104 is mounted and straight portion 128B of bolt-in belly band 128, which will be detailed further below. Preferably, the high chip exit angle Θ is within the range of 20° and 45°. In certain preferred embodiments, the high chip exit angle Θ is approximately 35°. Placing parting line 110 and hood mounting plane 112 vertically above chipper disk axis 118 and processing plane 114, as described above, increases the relative height of the base 104 and decreases the relative height of the hood 106 of housing 102 when compared to the relative heights of the base 36 and hood 37 of conventional housing 35 shown in FIGS. 4 and 5. Preferably, hood mounting plane 112 is placed at least about 2.5% of the diameter D of chipper disk 130 above processing plane 114. In certain preferred embodiments, hood mounting plane 112 is placed approximately 5% to 10% of the diameter D of chipper disk 130 above processing plane 114. Increasing the height of the base 104 enables the size of the inlet of the spout 120 (i.e., the inlet is joined to the base 104 of the housing 102 to enable chips to pass from the housing into the spout) to be increased and also the exit angle Θ of the spout to be increased. In preferred embodiments, exit angle Θ is between 35 degrees and 75 degrees. By raising exit angle Θ and increasing the inlet size of the spout 120, chips are more likely to enter the spout and exit the machine 100 without traveling around the housing 102 (i.e., travel into the hood 108 before exiting the spout). This reduces wear on the hood 108, minimizes the production of unwanted pins and fines, and also reduces heat generated from the friction of chips passing through the hood.

Wear Components

As mentioned previously, use of the machine 100 may result in chips contacting and damaging (i.e., wearing away) various portions of the machine. More particularly, chips typically fly at high velocities into contact with an inner surface of the housing 130, including the base 104 or hood 108, which can wear away those surfaces and require them to be replaced. Conventionally, these worn components were cut out and then new components were welded in their place. The presently-disclosed machine 100 provides for a simpler method for maintaining the machine and replacing wear components. As discussed below, the present disclosure provides wear components that are adapted for use on a chipping machine that each preferably include a mounting component for removably mounting the wear component to a mounting surface inside of the housing a sacrificial chip contact surface that is sized and configured to be contacted by chips traveling within the housing at a high speed, to reduce the speed of the chips that contact the contact surface, and to be worn away by such contact with said chips. Advantageously, these wear components can be easily removed and repaired or replaced with new components once they become worn.

Figure 1:
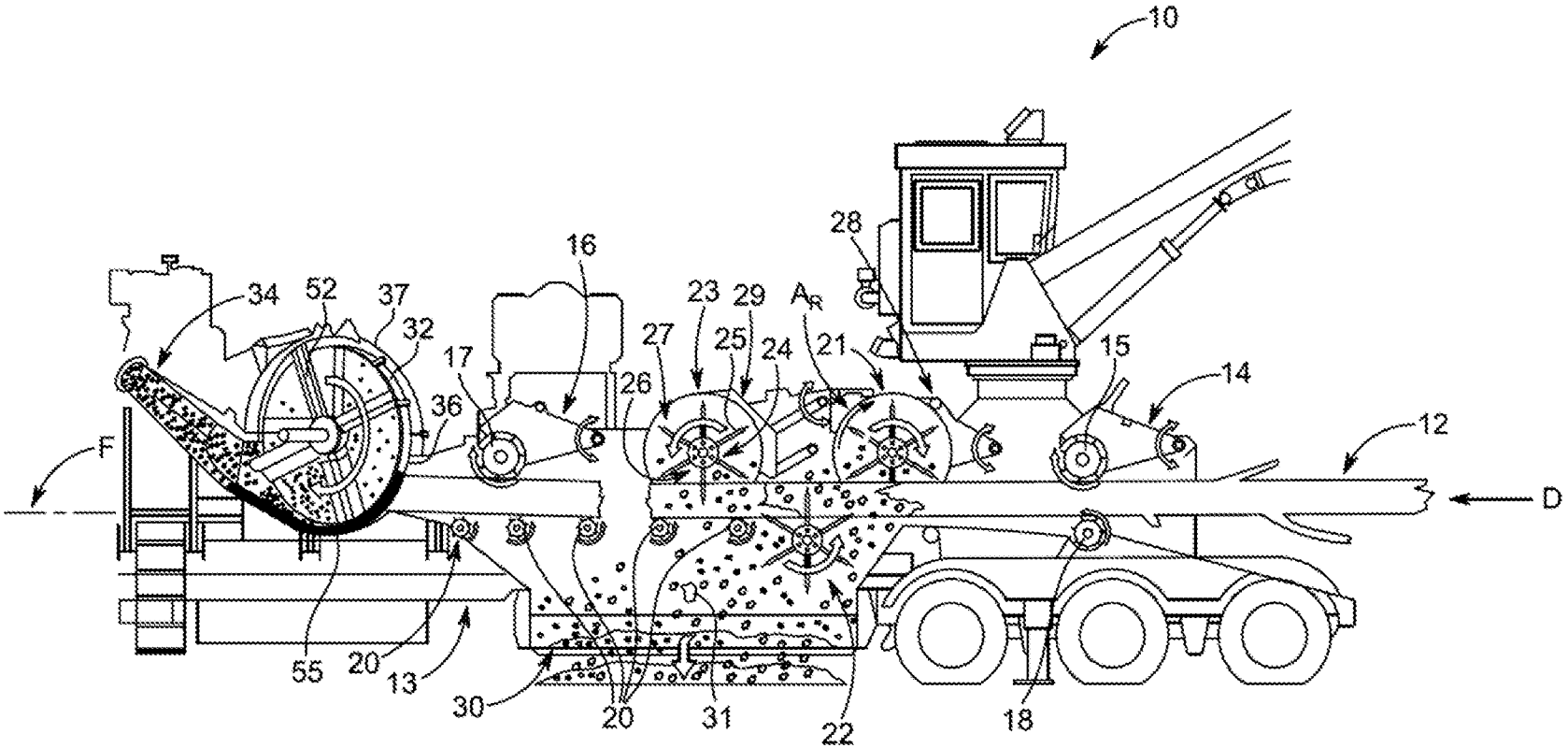
FIGURE 1 (Prior Art)
FIG. 1 is a side elevation view, partially in section, of a conventional combination debarking and chipping machine.
Figure 2:
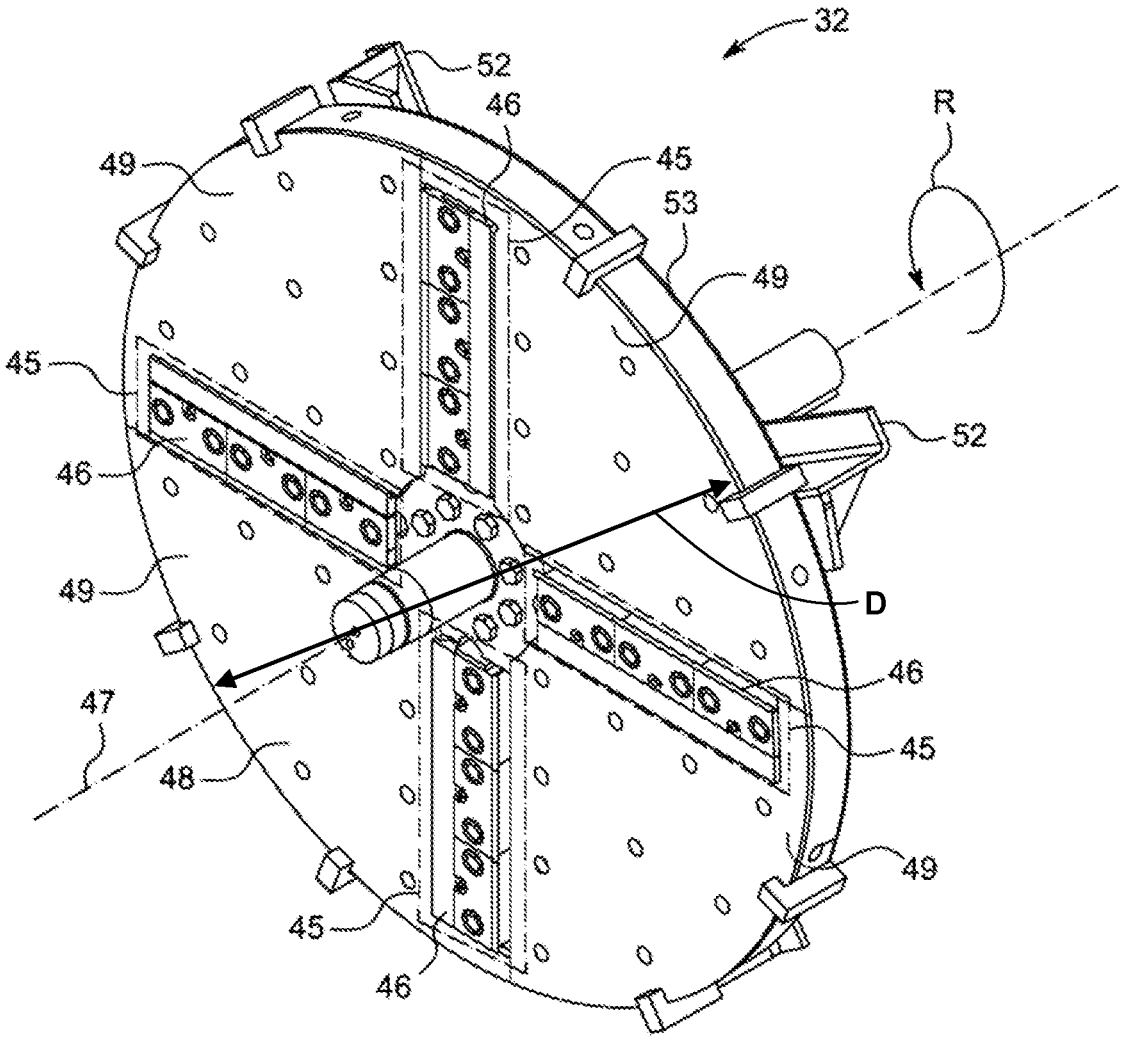
FIGURE 2 (Prior Art)
FIG. 2 is a perspective view of a conventional chipper disc.
Figure 3:
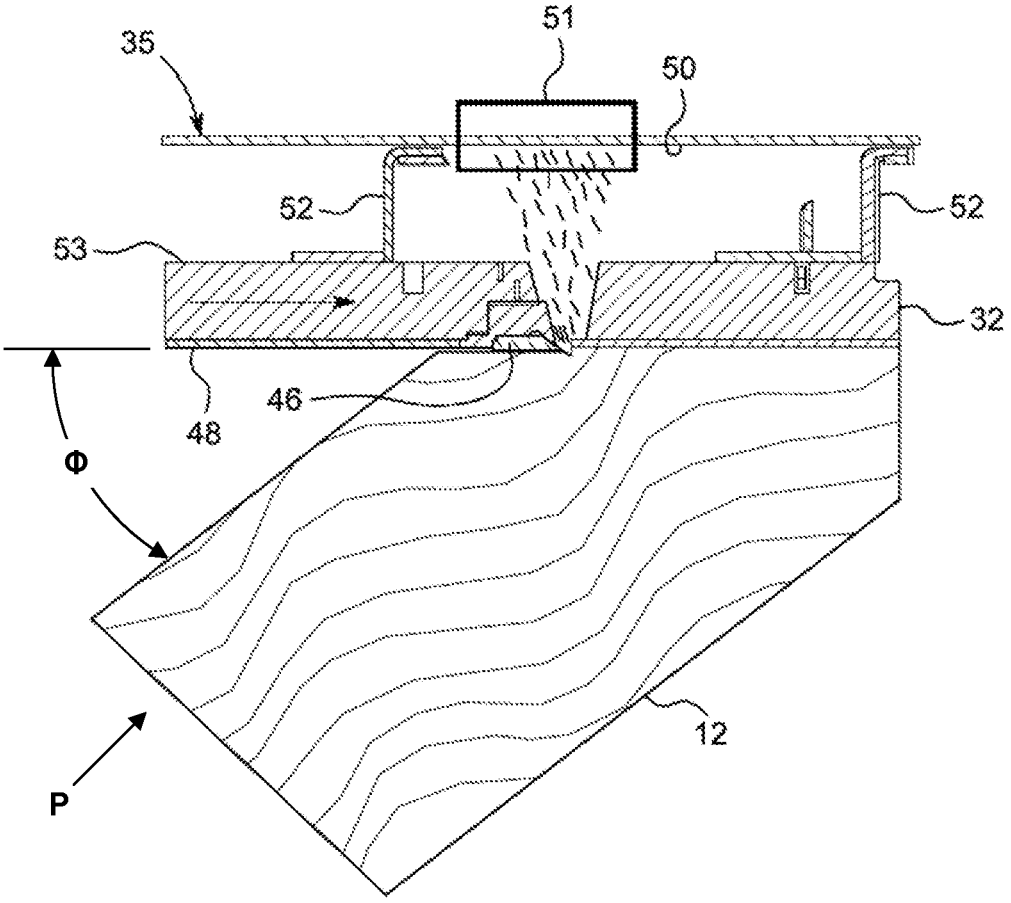
FIGURE 3 (Prior Art)
FIG. 3 depicts a log being chipped using the chipper disc of FIG. 2.

First, with reference to FIGS. 8, 9 and 11, removable and sacrificial belly band 128 may be used in place of the conventional welded-in belly band 55 shown in FIG. 1. Preferably, as shown in FIG. 8, base 104 comprises first side 104A, second side 104B opposite and spaced apart from the first side, and belly band 128 is disposed between the first side and the second side. The first side 104A of the base 104 is preferably substantially parallel to second side 104B of the base. The belly band 128 is removably connected between the first and second sides 104A, 104B, such as by a bolt connection. Thus, in combination, the sides 104A, 104B and the belly band 128 that form the base 104 are adapted to substantially surround a lower portion of the chipper disk 132.

The belly band 128 preferably includes a curved portion 128A that is placed below chipping disk 130 and a straight portion 128B that extends towards and preferably forms a bottom of spout exit 132. A plurality of bolts 134 (shown in FIG. 9) mount belly band 128 to base 104. Preferably, bolts 134 may be removed from housing 102 without accessing the interior of the housing (i.e., bolts are inserted into an externally accessible portion of the housing). Belly band 128 is an easily replaceable wear component that is configured to be unbolted and removed from the housing 102 without removing chipping disk 130. In the illustrated embodiment, curved portion 128B has a circular shape with a diameter that is slightly larger than the diameter of the chipping disk 130. The curvature of curved portion 128A, the length of straight portion 128B, and the size of spout exit 132 are preferably configured to allow belly band 128 to be unbolted from housing 102 and then for the belly band to be removed from housing by rolling or sliding the belly band around the bottom of the chipping disk and out via the spout exit. As such, when belly band 128 becomes worn, it may be easily replaced without opening the housing 102 simply through unbolting and without requiring any cutting or welding.

Figure 13:
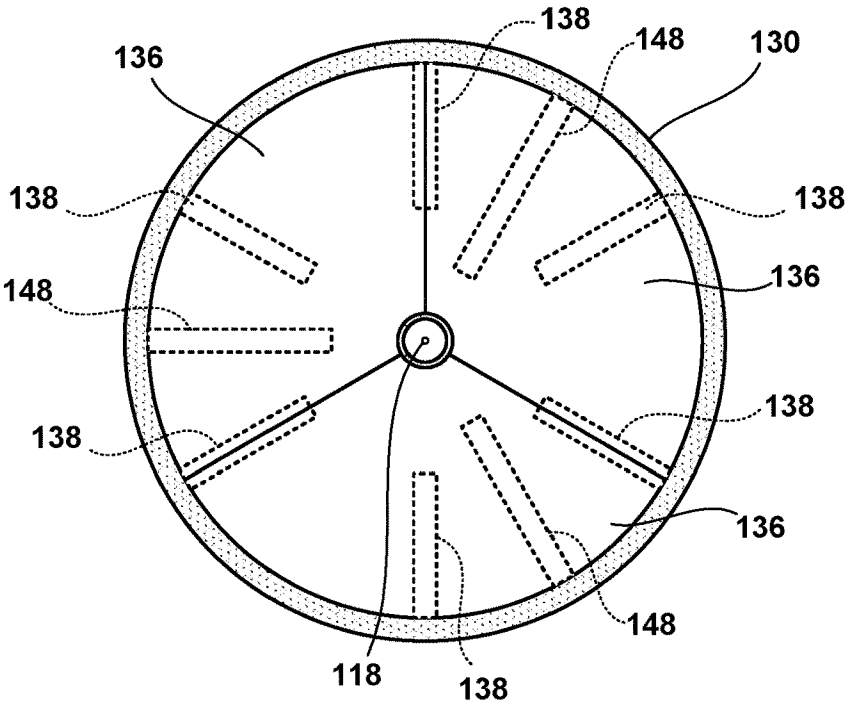
FIG. 13 is an elevation view depicting three wear plate sections mounted to a discharge side of a chipper disc via paddles according to an embodiment of the present invention.
Figure 12:
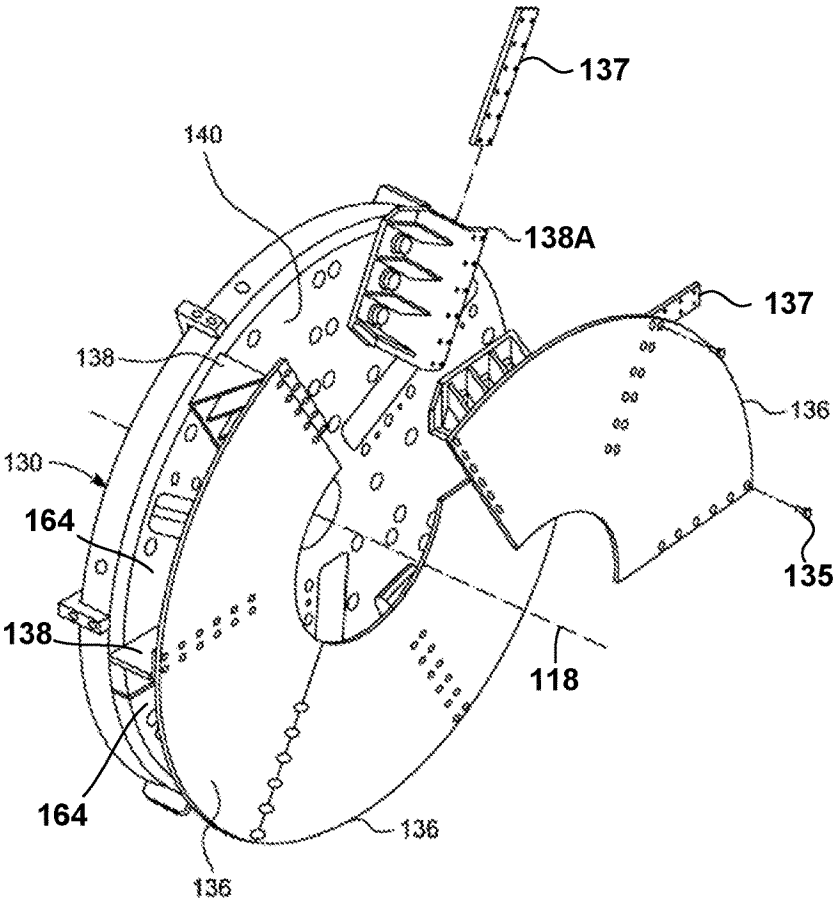
FIG. 12 is a perspective view of the chipper disc of FIG. 9 with a single wear plate removed.

Second, referring again to FIGS. 9-10B and with further reference to FIGS. 12 and 13, chipping machine 100 is also provided with a wear plate that is formed by one or more rotating wear plate sections 136 that are removably mounted to chipping disk 130. Wear plate sections 136 are each preferably removably mounted to one end of paddles 138, where the paddles each have another end that is attached to a discharge or rear face 140 of the chipper disk 130. In certain embodiments, fasteners 135 are inserted through each of the wear plate sections 136 and are secured in threaded openings formed in plates 137 that are placed under a lip 138A of the paddles 138. The lip 138A preferably extends laterally outwards from the outermost end of the paddle 138 and is parallel with the rear face 140 of the chipper disk 130. In certain embodiments, a first end of each wear component section 136 is bolted to a first paddle 138, a second end of each wear component section is bolted to a second paddle, and at least one third paddle is located between the first and second paddles such that at least two separate covered sections 164 are formed between the rear face 140 of the chipping disc 130 and the wear component section, where a paddle separates each adjacent covered section. In other embodiments, ends of each adjacent pair of wear component sections 136 are bolted to each paddle, as shown in FIG. 10A, such that a single covered section 164 is formed between the rear face 140 of the chipping disc 130 and each wear component section.

Wear plate sections 136 and paddles 138 rotate together with the chipper disk 132. When the chipping machine 100 is in operation, a log 111 is advanced towards a front face 144 of chipping disk 130 and comes into contact with knife assemblies 146, which creates chips from the log. These chips are forcefully thrown towards a back wall 148 of chipper disk housing 102, including towards wear section 150, which would be worn away by the chips, as discussed above, in the absence of wear plate sections 136. However, due to the presence of the wear plate sections 136, chips are prevented from contacting and wearing the housing 102. Additionally, because the wear plate sections 136 are rotating, the amount of wear caused by chips on the wear plates is reduced when compared to the amount of wear that would be caused to a stationary wear plate or the stationary housing 102.

Trash Chute

With reference again to FIG. 6, in addition to the first path for expelling trash from the machine 100 provided by the bark removal discharge 30, the machine is preferably provided with a second path that is further downstream for also expelling trash from the machine. This second path includes a trash chute 152 that is located at the bottom of the housing 102 on the upstream side of the chipper assembly 103 (i.e., prior to the chipper disc). This chute allows unchippable materials 154, trash, tramp metal, etc. to fall into a bark removal conveyor 156, which is structurally similar to bark removal discharge 30 shown in FIG. 6, for removal from the machine. In certain preferred embodiments, these materials 154 are carried down the chute 152 to the conveyor 156 by the force of gravity alone. By opening the bottom of the housing 102 and allowing this type of refuse to be carried out via the bark removal conveyor 154, the danger of flying debris is eliminated. Additionally, advantageously, this refuse material is consolidated with the other refuse (i.e., bark) that falls onto the bark removal conveyor 156 from bark removal discharge 30 (shown in FIG. 1).

Although this description contains many specifics, these should not be construed as limiting the scope of the invention but as merely providing illustrations of some of the presently preferred embodiments thereof, as well as the best mode contemplated by the inventors of carrying out the invention. The invention, as described herein, is susceptible to various modifications and adaptations, and the same are intended to be comprehended within the meaning and range of equivalents of the appended claims.

What is claimed is:

1. A housing assembly adapted for use on a chipping machine having a base for surrounding a lower portion of a rotating chipper disk with a chipper disk upper portion, a chipper disk lower portion, at least one chipper knife assembly, and a centerline, said housing assembly further comprising:

a hood having:

a stationary portion configured for removable attachment to the base to form a housing for substantially enclosing the chipper disk;

an access opening formed in the stationary portion for providing access to an inside of the housing;

an access door covering the access opening and adapted to be moved between an open position where the access door is uncovered and a closed position where the access door is covered; and a parting line disposed at a junction of the base with the hood, wherein the hood and the access door are adapted to substantially surround the chipper disk upper portion while the base substantially surrounds the chipper disk lower portion; and wherein the stationary portion comprises a first side, a second side opposite and spaced apart from said first side, and a third side connecting the first side and the second side, and wherein the stationary portion is sized such that the parting line is disposed vertically higher than the centerline of the rotating chipper disk.

2. The housing assembly of claim 1 further comprising said base and a chute having an inlet formed in the base of the housing assembly on an upstream side of the chipper disk and an outlet, wherein the inlet is sized and configured to collect trash within the housing assembly and the chute is configured to automatically carry the trash out of the housing assembly under a force of gravity.

* * * * *